US011142833B2

(12) United States Patent
Choi et al.

(10) Patent No.: US 11,142,833 B2
(45) Date of Patent: Oct. 12, 2021

(54) ELECTROCHEMICAL OXIDATION OF AROMATIC ALDEHYDES IN ACIDIC MEDIA

(71) Applicant: Wisconsin Alumni Research Foundation, Madison, WI (US)

(72) Inventors: Kyoung-Shin Choi, Fitchburg, WI (US); Stephen Riley Kubota, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 119 days.

(21) Appl. No.: 15/727,992

(22) Filed: Oct. 9, 2017

(65) Prior Publication Data

US 2019/0106796 A1 Apr. 11, 2019

(51) Int. Cl.

| | |
|---|---|
| ***C25B 3/23*** | (2021.01) |
| ***C25B 11/04*** | (2021.01) |
| ***C25B 11/054*** | (2021.01) |

(52) U.S. Cl.

CPC ..... *C25B 3/23* (2021.01); *C25B 11/04* (2013.01); *C25B 11/054* (2021.01)

(58) Field of Classification Search

CPC ..... C25B 3/02; C25B 3/23
USPC ..... 205/440, 442, 422, 427, 443
See application file for complete search history.

(56) References Cited

U.S. PATENT DOCUMENTS

| | | | | |
|---|---|---|---|---|
| 1,709,297 | A * | 4/1929 | Yabuta | C25B 3/02 205/440 |
| 7,052,587 | B2 | 5/2006 | Gibson et al. | |
| 9,598,780 | B2 | 3/2017 | Choi et al. | |
| 2012/0010068 | A1 | 1/2012 | Zhao | |
| 2012/0271060 | A1 | 10/2012 | Munoz de Diego et al. | |
| 2013/0137882 | A1 | 5/2013 | Borsotti | |
| 2014/0235838 | A1 | 8/2014 | Stahl et al. | |
| 2014/0275679 | A1 | 9/2014 | Sofranko | |
| 2014/0295508 | A1 | 10/2014 | Yoshikuni et al. | |
| 2015/0183755 | A1* | 7/2015 | Subramaniam | B01J 4/002 549/485 |
| 2015/0292095 | A1 | 10/2015 | Haber et al. | |
| 2015/0361566 | A1 | 12/2015 | Choi et al. | |
| 2016/0024669 | A1 | 1/2016 | Jackson et al. | |

(Continued)

FOREIGN PATENT DOCUMENTS

| | | |
|---|---|---|
| JP | 04362199 A | 12/1992 |
| WO | WO2016186504 | 11/2016 |

(Continued)

OTHER PUBLICATIONS

Palmisano et al., Waste-Free Electrochemical Oxidation of Alcohols in Water, Adv. Synth. Catal. 348, 2006, pp. 2033-2037.

(Continued)

*Primary Examiner* — Edna Wong

(74) *Attorney, Agent, or Firm* — Bell & Manning, LLC; Michelle Manning

(57) ABSTRACT

Methods for electrochemically oxidizing aromatic aldehydes, such as furfural and furfural derivatives, to carboxylic acids in acidic solutions are provided. Also provided are electrochemical cells for carrying out the oxidation reactions. The electrochemical oxidations may be conducted in aqueous media at ambient pressure and mild temperatures.

20 Claims, 5 Drawing Sheets

(56) References Cited

U.S. PATENT DOCUMENTS

| | | | | |
|---|---|---|---|---|
| 2016/0201204 | A1* | 7/2016 | Choi | C25B 3/02 205/427 |
| 2017/0250433 | A1 | 8/2017 | Zhang et al. | |
| 2018/0023199 | A1* | 1/2018 | Sun | C07C 33/22 429/94 |
| 2018/0142362 | A1* | 5/2018 | Schouten | C25B 11/0415 |
| 2019/0071787 | A1* | 3/2019 | Choi | C25B 11/0415 |
| 2020/0055832 | A1* | 2/2020 | Crockatt | C25B 3/02 |
| 2020/0248322 | A1 | 8/2020 | Choi et al. | |
| 2020/0255960 | A1 | 8/2020 | Choi et al. | |

FOREIGN PATENT DOCUMENTS

| | | | | |
|---|---|---|---|---|
| WO | WO2016186505 | | 11/2016 | |
| WO | WO-2016186505 | A1 * | 11/2016 | C07B 63/02 |
| WO | WO2017101113 | | 6/2017 | |

OTHER PUBLICATIONS

Chadderdon et al., Electrocatalytic oxidation of 5-hydroxymethylfurfural to 2,5-furandicarboxylic acid on supported Au and Pd bimetallic nanoparticles, Green Chem. 16, Apr. 24, 2014, pp. 3778-3786.
Kwon et al., Electrocatalytic Hydrogenation of 5-Hydroxymethylfurfural in the Absence and Presence of Glucose, ChemSusChem 6, Jul. 15, 2013, pp. 1659-1667.
Nilges et al., Electrochemistry for biofuel generation: production of furans by electrocatalytic hydrogenation of furfurals, Energy Environ. Sci. 6, Aug. 6, 2013, pp. 2925-2931.
Vuyyuru et al., Oxidation of biomass derived 5-hydroxymethylfurfural using heterogeneous and electrochemical catalysis, Catalysis Today 195, Jun. 8, 2012, pp. 144-154.
Presentation by John Roylance at job interview, Aug. 2014.
McDonald et al., A new electrochemical synthesis route for a BiOI electrode and its conversion to a highly efficient porous BiVO4 photoanode for solar water oxidation, Energy Environ. Sci. 5, 2012, pp. 8553-8557.
Seabold et al., Efficient and Stable Photo-Oxidation of Water by a Bismuth Vanadate Photoanode Coupled with an Iron Oxyhydroxide Oxygen Evolution Catalyst, J. Am. Chem.Soc. 134, Jan. 20, 2012, pp. 2186-2192.
Park et al., Progress in bismuth vanadate photoanodes for use in solar water oxidation, Chem. Soc. Rev. 42, Oct. 23, 2012, pp. 2321-2337.
Kim et al., Nanoporous BiVO4 Photoanodes with Dual-Layer Oxygen Evolution Catalysts for Solar Water Splitting, Science 343, Feb. 28, 2014, pp. 990-994.
Wei et al., Photoelectrochemical Cell and Its Applications in Optoelectronics, Int. J. Electrochem. Sci., vol. 2, Oct. 20, 2007, pp. 897-912.
Hansen et al., Cu catalyzed oxidation of 5-hydroxymethylfurfural to 2,5-diformylfuran and 2,5-furandicarboxylic acid under benign reaction conditions, Applied Catalysis A: General 456, Feb. 21, 2013, pp. 44-50.
Bragd et al., TEMPO-mediated oxidation of polysaccharides: survey of methods and applications, Topics in Catalysis, vol. 27, Nos. 1-4, Feb. 2004, pp. 49-66.
International Search Report and Written Opinion mailed in PCT Application No. PCT/US16/12312, dated May 10, 2016.
Grabowski et al., The electrochemical oxidation of 5-hydroxymethylfurfural with the nickel oxide/hydroxide electrode, Electrochimica Acta, vol. 36. No. 13, 1991, p. 1995.
Cha et al., Combined biomass valorization and hydrogen production in a photoelectrochemical cell, Nature Chemistry, vol. 7, Mar. 9, 2015, pp. 328-333.
Cottier et al., Oxidation of 5-Hyrodxymethylfurfural and Derivatives to Furanaldehydes with 2,2,6,6-Tetramethylpiperidine Oxide Radical—Co-oxidant Pairs, J. Heterocyclic Chem. (May-Jun. 1995), vol. 32, pp. 927-930.
Green et al., The Electrocatalytic Hydrogenation of furanic compounds in a continuous electrocatalytic membrane reactor, Green Chern., May 10, 2013, vol. 15, pp. 1869-1879.
Parpot et al., Electrochemical Investigations of the Oxidation-Reduction of Furfural in Aqueous Medium Application to Electrosynthesis, Electrochimica Acta, Oct. 9, 2003, vol. 49, pp. 397-403.
Chen et al., Electro-Generation of Furfural Alcohol in Ni—P-mCMC/mCS Bipolar Membrane Equipped Electrolysis Cell, Advanced Materials Research, vols. 287-290, Jul. 4, 2011, Trans Tech Publications, pp. 564-568.
Jiang et al., Integrating electrocatalytic 5-Hydroxymethylfurfural Oxidation and Hydrogen Production via Co-P-Derived Electrocatalysts, ACS Energy Lett. 1, Jul. 18, 2016, pp. 386-390.
You et al., Simultaneous H2 generation and biomass upgrading in water by an efficient noble-metal-free bifunctional electrocatalyst, Angew. Chern. Int. Ed., 55, Jul. 15, 2016, pp. 9913-9917.
You et al., A general strategy for decoupled hydrogen production from water splitting by integrating oxidative biomass valorization, J. Am. Chern. Soc., 138, Sep. 21, 2016, p. 13639-13646.
You et al., Efficient H2 evolution coupled with oxidative refining of alcohols via a hierarchically porous nickel bifunctional electrocatalyst, ACS Catal., 7, May 30, 2017, pp. 4564-4570.
Shin et al., Nanoporous Structures Prepared by an Electrochemical Deposition Process, Adv. Mater. 15, No. 19, 2003, pp. 1610-1614.
Nam et al., Effects of (NH4)2S04 and BTA on the nanostructure of copper foam prepared by Electrodeposition, Electrochimica Acta 56, Aug. 16, 2011, pp. 9397-9405.
Kwon et al., Electrocatalytic Hydrogenation of 5-Hydroxymethylfurfural in Acidic Solution, ChemSusChem, vol. 8, Issue 10, Apr. 23, 2015, pp. 1745-1751.
Singh et al., Growth of Different Nanostructures of Cu2O (Nanothreads, Nanowires, and Nanocubes) by Simple Electrolysis Based Oxidation of Copper, J. Phys. Chern, 111, Jan. 1, 2007, pp. 1638-1645.
Yin et al, Electrochemical Oxidation of Covellite (CuS) in Alkaline Solution, Journal of Colloid and Interface Science, vol. 166, Issue 1, Aug. 1, 1994, pp. 133-142.

* cited by examiner

ELECTROCHEMICAL OXIDATION OF AROMATIC ALDEHYDES IN ACIDIC MEDIA

REFERENCE TO GOVERNMENT RIGHTS

This invention was made with government support under DMR-1121288 awarded by the NSF. The government has certain rights in the invention.

BACKGROUND

Biomass is a promising sustainable material source for the manufacture of key building block chemicals as well as fuels to reduce or eliminate dependence on fossil fuels. 5-Hydroxymethyfurfural (HMF), which can be derived from cellulosic biomass, has generated a considerable interest as a platform molecule to synthesize industrially and commercially desirable products. For example, 2,5-furandicarboxylic acid (FDCA), one of the oxidation products of HMF, can serve as a monomer in the synthesis of a variety of polymeric materials. In particular, it is known to be an excellent replacement for terephthalic acid in many polyesters such as polyethylene terephthalate (PET).

Traditional HMF oxidation to FDCA typically relies on chemical oxidants or noble metal catalysts in high temperature and $O_2$ pressure reactions. Aqueous electrochemical oxidation is a very promising alternative, because reactions are driven by an applied potential, removing the need for chemical oxidants and high pressure $O_2$.

Studies have shown that efficient and selective electrochemical oxidation of HMF to FDCA is indeed possible; however these reactions operate at elevated pH where FDCA is soluble. In an industrial application, lowering the pH after every reaction to precipitate the FDCA generates a tremendous amount of salt as waste and adds costs associated with purchasing the necessary acid/base and removing excess salt from solution.

SUMMARY

Methods and electrochemical cells for electrochemically oxidizing aromatic aldehydes to carboxylic acids in acidic solutions are provided.

One embodiment of a method for the electrochemical oxidation of an aromatic aldehyde is carried out in an electrochemical cell that includes: an anode that is active for the electrochemical oxidation of the aromatic aldehyde in an anode electrolyte solution; and a cathode in a cathode electrolyte solution. The anode electrolyte solution includes the aromatic aldehyde and has a pH lower than 7. The method entails: applying an anodic potential to the anode that induces the electrochemical oxidation of the aromatic aldehyde to a carboxylic acid. In embodiments of the method wherein the aromatic aldehyde is 5-hydroxymethylfurfural and the carboxylic acid is 2,5-furandicarboxylic acid, the 2,5-furandicarboxylic acid can be produced with a yield of at least 10%.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
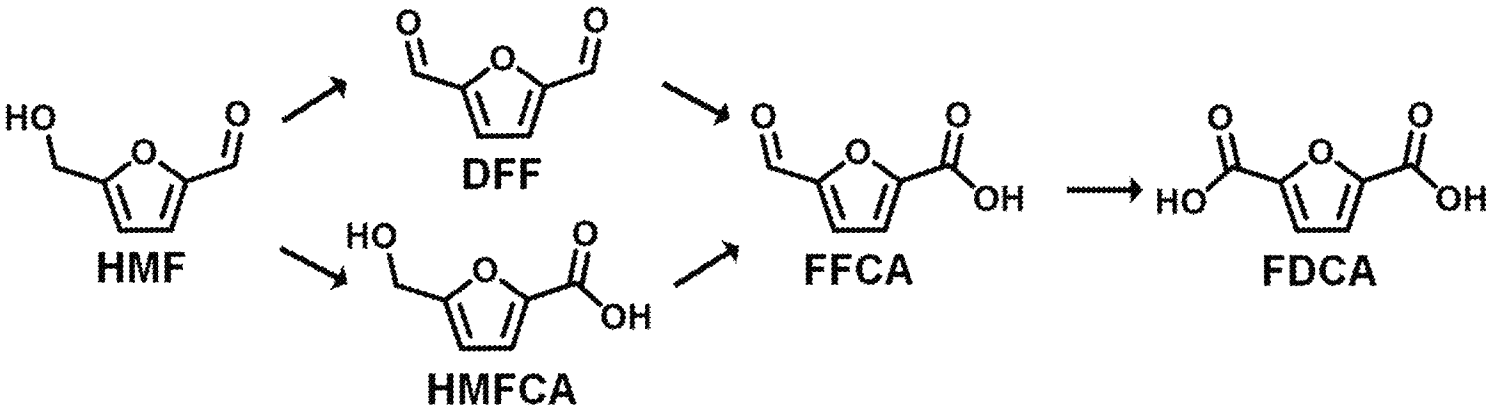
FIG. 1 depicts possible reaction schemes for the oxidation of HMF to FDCA.

Methods for electrochemically oxidizing aromatic aldehydes, such as furfural and furfural derivatives, to carboxylic acids, for example, dicarboxylic acids, in acidic solutions are provided. Also provided are electrochemical cells for carrying out the oxidation reactions. The electrochemical oxidations may be conducted in aqueous media at ambient pressure (about 1 atm) and mild temperatures (0° C.<T<100° C.).

In some embodiments of the methods, the use of an acidic solution is advantageous because it results in the precipitation of the carboxylic acid, which facilitates its separation from the solution. In some embodiments of the methods, the use of an acidic solution is advantageous because it results in the formation of products that would not form, or that would form only in minimal amounts, in neutral or basic solutions. By way of illustration, embodiments of the methods can be carried out in anode electrolyte solutions having a pH of less than 7. This includes anode electrolyte solutions having a pH of no higher than 5, anode electrolyte solutions having a pH of no higher than 4, anode electrolyte solutions having a pH of no higher than 3, anode electrolyte solutions having a pH of no higher than 2, and anode electrolyte solutions having a pH of no higher than 1. For example, the electrochemical oxidations can be carried out in anode electrolyte solutions having a pH in the range from 0.1 to 6.

The electrochemical methods and cells use anodes that are active for the oxidation of the aromatic aldehydes. For the purposes of this disclosure, an anode is active for the oxidation of an aromatic aldehyde if at least a portion of the anodic current is used for the electrochemical oxidation of the aromatic aldehyde during the operation of the cell—even if some of the current generated at the anode is associated with the electrochemical oxidation of water.

Some embodiments of the anodes are more active for the oxidation of the aromatic aldehydes than they are for the oxidation of water in the acidic solution in which the oxidation is carried out. For these anodes it is possible to oxidize the aromatic aldehyde without oxidizing water by operating the electrochemical cell at a voltage that allows only for the oxidation of the aromatic aldehyde and its oxidation intermediates.

Examples of anode materials that can be used in the methods and cells include, metal oxides, such as $MnO_x$, where the x indicates that the oxidation state of Mn in the compound can be 3+, 4+, or a mix of 3+ and 4+. Other anode materials include oxides, such as $PbO_2$, $CeO_2$, $WO_3$, $TiO_2$, $Ta_2O_5$, $Nb_2O_5$, $IrO_2$, and $RuO_2$, metals, such as Au, Pd, and Pt, and carbon-based electrodes (e.g., graphitic carbon, glassy carbon, and the like).

The aromatic aldehydes have an aromatic ring with at least one aldehyde group-containing substituent. The aromatic rings can be homocyclic or heterocyclic rings. Other types of functional groups may also be present on the aromatic ring—in addition to aldehyde groups. For example, the aromatic aldehydes can include one or more alcohol groups and/or one or more carboxylic acid groups on the aromatic ring. Furfural ($C_5H_4O_2$) and furfural derivatives are examples of aromatic aldehydes that can be electrochemically oxidized. As used herein, a furfural derivative is a compound that has a furan ring with at least one aldehyde substituent and one or more additional ring substituents. Examples of furfural derivatives include HMF, 2,5-diformylfuran (DFF), and 2-formyl-5-furancarboxylic acid (FFCA).

HMF can be oxidized to form the aromatic dicarboxylic acid, FDCA, in an oxygen-donating, acidic electrolyte solution, such as water, as illustrated in Example 1. This oxidation involves the electrochemical oxidation of the aldehyde group of HMF to a carboxylic acid and also the electrochemical oxidation of the alcohol group of HMF to a carboxylic acid, which can occur under the same oxidation conditions. Two possible pathways to form FDCA are shown in FIG. 1. One pathway forms DFF as the first intermediate by the oxidation of the alcohol group of HMF, while the other pathway forms 5-hydroxymethyl-2-furancarboxylic acid (HMFCA) as the first intermediate by the oxidation of the aldehyde group of HMF. In an anode electrolyte that serves as an oxygen donor, both DFF and HMFCA are further oxidized to form 5-formyl-2-furancarboxylic acid (FFCA) and then FDCA.

Among the various approaches used to oxidize HMF to FDCA, electrochemical oxidation of HMF in aqueous media can provide several distinct advantages. First, as the oxidation is driven by the electrochemical potential applied to the electrode, the use of chemical oxidants that may be environmentally harmful can be completely eliminated. Since water serves as an oxygen donor for the formation of the carboxylic acid groups from the alcohol and aldehyde groups, no chemicals other than HMF and water are necessary to form FDCA. Second, electrochemical oxidation can be effectively performed at ambient pressure and mild temperatures. Third, since electrochemical oxidation is coupled with electrochemical reduction, electrons obtained at the anode from HMF oxidation can be simultaneously used for a valuable reduction reaction at the cathode, which can significantly increase the value of the electrochemical approach. Additionally, because FDCA is insoluble near room temperature and low pH (e.g., ≤3), carrying out the electrochemical oxidation of HMF in a sufficiently acidic anode electrolyte solution has the further advantage of facilitating the recovery of the FDCA through precipitation. This can be accomplished by carrying out the electrochemical oxidation of HMF in an acidic solution at a temperature at which the FDCA precipitates out of the anode electrolyte solution as it is formed. Alternatively, the electrochemical oxidation of HMF in an acidic solution can be carried out at a temperature at which the FDCA remains soluble in the anode electrolyte solution. Then, once the electrochemical oxidation is complete, the temperature of the anode electrolyte solution can be cooled to a temperature at which the FDCA becomes insoluble and precipitates out of the anode electrolyte solution. The precipitated FDCA can then easily be separated from the solution.

Figure 4:
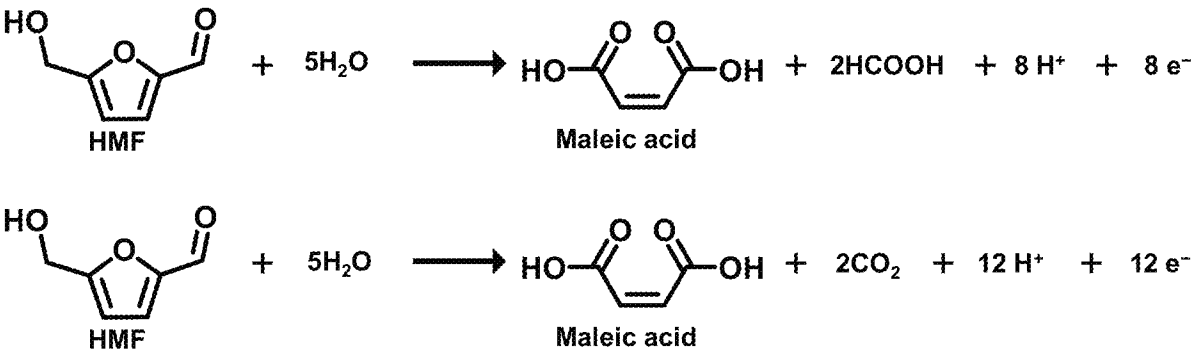
FIG. 4 shows possible reaction schemes for the oxidation of HMF to maleic acid.
Figure 5:
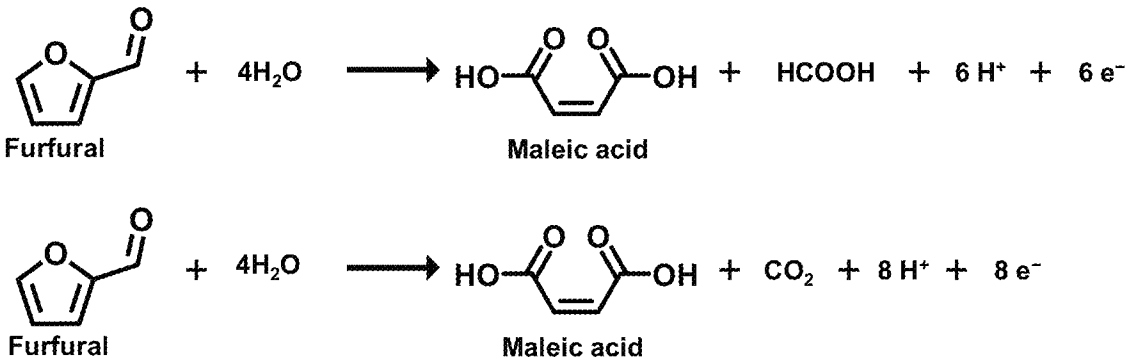
FIG. 5 shows possible reaction schemes for the oxidation of furfural to maleic acid.

HMF can also be oxidized to form maleic acid in an oxygen-donating, acidic electrolyte solution, as illustrated in Example 2. Possible reaction schemes for the oxidation of HMF to maleic acid are shown in FIG. 4, where the byproducts can be $CO_2$ and/or HCOOH. Furfural is another molecule that can be oxidized to form maleic acid in an oxygen-donating, acidic electrolyte solution, as illustrated in Example 3. Possible reaction schemes for the oxidation of furfural to maleic acid are shown in FIG. 5. The use of an acidic anode electrolyte solution may facilitate the formation of maleic acid via the electrochemical oxidation of furfural and furfural derivatives, as these compounds would not form, or would form only in minimal amounts, in neutral or basic anode electrolyte solutions. Maleic acid is a useful product, since it can serve as an intermediate in the production of succinic acid, a commercially valuable chemical.

In some embodiments of the electrochemical oxidation methods, HMF is oxidized in an acidic anode electrolyte solution to form a mixture of FDCA and maleic acid. These two products are readily separated since the FDCA precipitates out of the solution at or near room temperature, while the maleic acid remains soluble.

One embodiment of an electrochemical cell for carrying out the electrochemical oxidations comprises an anode in an acidic anode electrolyte solution comprising a solvent, typically water, and an aromatic aldehyde. An acid, such as sulfuric acid, can be added to the anode electrolyte solution to provide an acidic pH. The anode electrolyte solutions may further include a buffer to maintain a given pH. A cathode in a cathode electrolyte solution is in electrical communication with the anode. The solvent of the anode and cathode electrolyte solutions may the same or different. To operate the electrochemical cell, a voltage source is used to apply an anodic potential to the anode and a potential difference is created between the anode and the cathode. Driven by this potential difference, electrons flow from the anode to the cathode through an external wire. The electrons at the surface of the cathode undergo reduction reactions with species contained in the cathode electrolyte solution, while oxidation reactions occur at the anode.

In some embodiments of the electrochemical cells, the cathode reaction is the reduction of water to $H_2$. However, other cathode reactions are possible, including the reduction of carbon dioxide to form carbon based fuels, such as methanol or methane, or the reduction of organic molecules to form more valuable organic chemicals. A variety of materials can be used for the cathode, depending on the reduction reaction that is being carried out. For example, if the reduction of water to $H_2$ is the cathode reaction, platinum, which is catalytic for hydrogen evolution, can be used as the cathode.

The electrochemical oxidation of the aromatic aldehydes can be carried out with substantial product yields. For example, HMF can be oxidized to FDCA with a product yield of at least 30%, at least 40%, or at least 50% or to maleic acid with a product yield of at least 10%, at least 20%, or at least 30%. Furfural can be oxidized to maleic acid with a product yield of at least 20%, at least 30%, or at least 40%. The product yield (%) is calculated using the following equation:

$$\text{Yield of product}(\%) = \frac{\text{mol. of product formed}}{\text{mol. of initial aromatic aldehyde}} \times 100.$$

EXAMPLES

Example 1: Electrochemical Oxidation of HMF to FDCA

This example illustrates the electrochemical oxidation of HMF to FDCA in acidic media using $MnO_x$ as an illustrative anode material. This approach eliminates the need to vary the pH of the reaction solution in order to recover the FDCA.

Manganese Oxide ($MnO_x$) as a Anode for HMF Oxidation

Figure 2B:
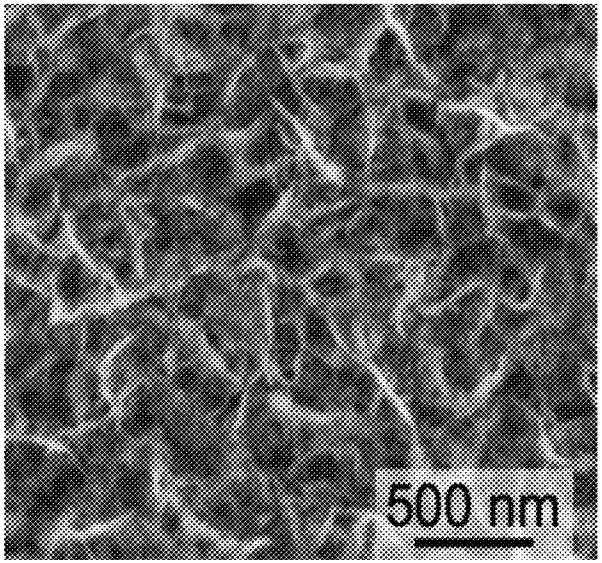
FIG. 2B shows an SEM image of a $MnO_x$ film after annealing.
Figure 2A:
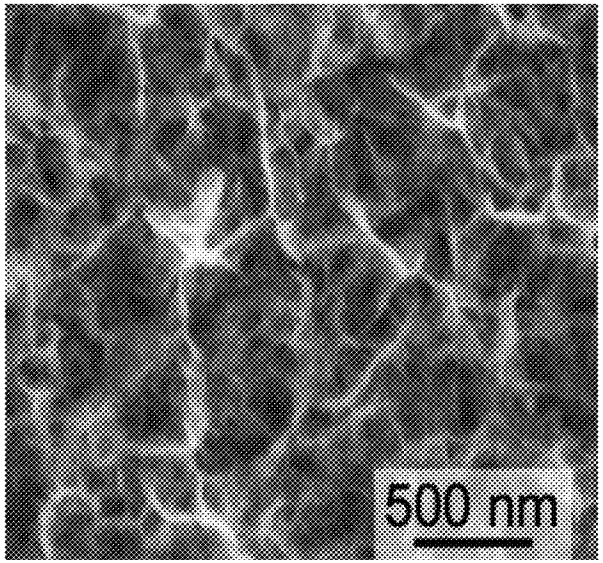
FIG. 2A shows a scanning electron microscope (SEM) image of a $MnO_x$ film, as deposited.

The $MnO_x$ electrodes used in this example were prepared by electrodeposition. (The notation of $MnO_x$ is used because the film contains a mixture of $Mn^{3+}$ and $Mn^{4+}$ ions in an ill-defined ratio and, therefore, the amount of oxygen present in the compound was not accurately determined.) An aqueous solution composed of 50 mM $MnSO_4$ and 100 mM $Na_2SO_4$ was used as a plating solution. Anodic electrodeposition was carried out in an undivided three-electrode cell. Glass coated with fluoride doped tin oxide (FTO) and Pt were used as the working electrode (WE) and counter electrode (CE), respectively. An Ag/AgCl (4 M KCl) electrode was used as the reference electrode (RE). $MnO_x$ was anodically deposited by applying 0.9 V to the WE in the plating solution kept at 60° C. while passing 0.5 C/cm$^2$. The anodic bias oxidized $Mn^{2+}$ ions in the plating solution to $Mn^{4+}$ ions, which are no longer soluble and precipitate as a $MnO_x$ film on the WE. The as-deposited films were washed with deionized (DI) water, dried in a stream of air, and then annealed at 400° C. for 2 hours, with a ramp rate of 2° C./min. The annealed film, as well as the as-deposited film, was X-ray amorphous. SEM images of the as-deposited and annealed samples showing their surface morphologies are displayed in FIGS. 2A and 2B, respectively.

Figure 3:
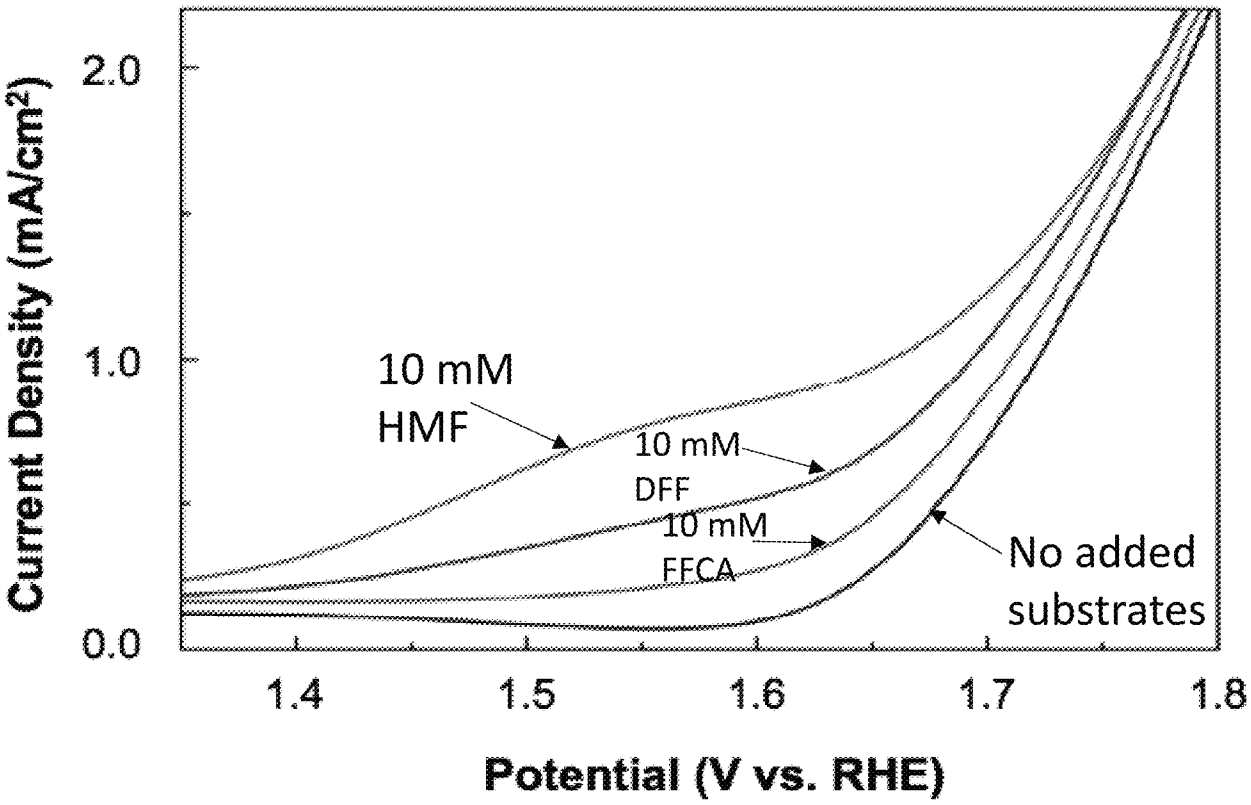
FIG. 3 depicts linear sweep voltammetry (LSV) curves of a $MnO_x$ electrode obtained in a pH $1H_2SO_4$ solution, as described in Example 1: without added substrates; with 10 mM HMF; 10 mM DFF; and 10 mM FFCA at a scan rate of 5 mV $s^{-1}$.

The activity of $MnO_x$ for HMF oxidation to FDCA was first examined using LSV in a $H_2SO_4$ (pH 1) solution with and without 10 mM HMF and the same concentration of HMF oxidation intermediates, DFF and FFCA (FIG. 3). The major competing reaction for HMF oxidation in aqueous conditions is the electrochemical oxidation of water, which can be observed in the LSV obtained without HMF and its oxidation intermediates.

After the addition of HMF, DFF, or FFCA, the oxidation current onset potential was commonly shifted to the less positive potential. This demonstrates that it is possible to oxidize HMF all the way to FDCA without oxidizing water by choosing a potential that allows only for the oxidation of HMF and its oxidation intermediates.

Constant potential oxidation of HMF to FDCA was carried out at 1.6 V vs. RHE (1.34 V vs. Ag/AgCl) at 60° C. using a cell divided with a glass frit. The WE compartment (anolyte) contained 15 mL of a $H_2SO_4$ solution (pH 1) containing 20 mM HMF, while the CE compartment (catholyte) contained 15 mL of a $H_2SO_4$ solution (pH 1) solution. The anode, cathode, and the overall reactions are summarized below.

Anode reaction: $HMF+2H_2O \rightarrow FDCA+6H^+ +6e^-$

Cathode reaction: $6H^+ +6e^- \rightarrow 3H_2$

Overall reaction: $HMF+2H_2O \rightarrow FDCA+3H_2$

The elevated temperature was used to improve the kinetics of HMF oxidation using $MnO_x$. Another advantage of using the elevated temperature is that the solubility of FDCA is considerably increased compared to that at room temperature (RT; ~23° C.). As a result, FDCA precipitation did not occur during electrochemical oxidation until the electrolysis was completed and the solution was cooled down to RT. This can be favorable, as the precipitation of FDCA on the electrode surface during electrolysis may hinder electrochemical oxidation. By using an acidic medium, the separation of FDCA was enabled by altering temperature instead of altering pH, which significantly simplifies the separation process.

The concentration changes of HMF and its oxidation products in the anolyte were determined using high-performance liquid chromatography (HPLC). The yields (%) of the oxidation products were calculated using the following equation:

$$\text{Yield of product}(\%) = \frac{\text{mol. of product formed}}{\text{mol. of initial } HMF} \times 100.$$

The stoichiometric amount of charge required to completely convert 15 mL of 20 mM HMF solution to FDCA is 174 C. The product analysis obtained at 250 C showed that FDCA yield was 54%.

The major byproduct was maleic acid, obtained by the reaction shown in FIG. 4. The formation of maleic acid does not affect the separation process of FDCA, as it is highly soluble in acidic pH. Maleic acid can also serve as an intermediate to produce succinic acid that, along with FDCA, is a value-added chemical that can be derived from biomass.

Example 2: Electrochemical Oxidation of HMF to Maleic Acid

This example illustrates the electrochemical oxidation of HMF to maleic acid in acidic media using lead oxide ($PbO_2$) as an illustrative anode material.

The $PbO_2$ electrodes used in this example were prepared by electrodeposition. An aqueous solution composed of 50 mM $Pb(NO_3)_2$ lowered to a pH of 1 with nitric acid was used as the plating solution. Anodic electrodeposition was carried out in an undivided three-electrode cell. FTO and Pt were used as the WE and CE, respectively. An Ag/AgCl (4 M KCl) electrode was used as the RE. $PbO_2$ was anodically deposited by applying 2 V to the WE while passing 0.25 C/cm$^2$. Under the applied anodic bias, soluble $Pb^{2+}$ species were oxidized to insoluble $Pb^{4+}$ species, which deposited onto the WE as $PbO_2$. After deposition, films were rinsed with DI water, dried in a stream of air and then used as-deposited.

Constant potential oxidation of HMF was carried out at 2.0 V vs. RHE (1.74 V vs. Ag/AgCl) at 60° C. using a cell divided with a glass frit. The WE compartment contained 15 mL of a $H_2SO_4$ solution (pH 1) containing 20 mM HMF, while the CE compartment contained 15 mL of a $H_2SO_4$ solution (pH 1). The stoichiometric amount of charge required to completely convert 15 mL of 20 mM HMF solution to maleic acid, assuming that only $CO_2$ is formed as a byproduct, is 347 C. Products were analyzed via HPLC. At 200 C of charge passed the maleic acid yield was 35.5%. Maleic acid was the major, identifiable HMF oxidation product. The formation of FDCA was negligible.

Example 3: Electrochemical Oxidation of Furfural to Maleic Acid

This example illustrates the electrochemical oxidation of furfural to maleic acid in acidic media using manganese oxide ($MnO_x$) as an illustrative anode material.

The $MnO_x$ electrodes used in this example were prepared as in Example 1. Constant potential oxidation of furfural was carried out at 1.7 V vs. RHE (1.44 V vs. Ag/AgCl) at 60° C. using a cell divided with a glass frit. The WE compartment contained 15 mL of a $H_2SO_4$ solution (pH 1) containing 10 mM furfural, while the CE compartment contained 15 mL of a $H_2SO_4$ solution (pH 1). Products were analyzed via nuclear magnetic resonance (NMR) because the HPLC setup used in example 1 and 2 could not provide accurate quantification of furfural. The stoichiometric amount of charge required to completely convert 15 mL of 10 mM furfural solution to maleic acid, assuming that only $CO_2$ is formed as a byproduct, is 116 C. At 179 C of charge passed the maleic acid yield was 47%. Maleic acid was the major, identifiable furfural oxidation product.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A method for the electrochemical oxidation of an aromatic aldehyde that does not have one or more carboxylic acid groups attached directly to its aromatic ring to a carboxylic acid, wherein the electrochemical oxidation is carried out in an electrochemical cell comprising:

an anode that is active for the electrochemical oxidation of the aromatic aldehyde that does not have one or more carboxylic acid groups attached directly to its aromatic ring in an anode electrolyte solution; and a cathode in a cathode electrolyte solution, wherein the anode electrolyte solution comprises the aromatic aldehyde that does not have one or more carboxylic acid groups attached directly to its aromatic ring and has a pH of 4 or lower, and further wherein, prior to applying an anode potential to the anode, the concentration of the aromatic aldehyde that does not have one or more carboxylic acid groups attached directly to its aromatic ring in the anode electrolyte solution is higher than the concentration of any carboxylic acid that is an oxidation product of the aromatic aldehyde that does not have one or more carboxylic acid groups attached directly to its aromatic ring, the method comprising: applying the anode potential to the anode that induces the electrochemical oxidation of the aromatic aldehyde that does not have one or more carboxylic acid groups attached directly to its aromatic ring to the carboxylic acid, wherein the electrochemical oxidation of the aromatic aldehyde that does not have one or more carboxylic acid groups attached directly to its aromatic ring takes place directly at the anode, and further wherein, if the aromatic aldehyde that does not have one or more carboxylic acid groups attached directly to its aromatic ring is 5-hydroxymethylfurfural and the carboxylic acid is 2,5-furandicarboxylic acid, then the 2,5-furandicarboxylic acid is produced with a yield of at least 10%, and further wherein the aromatic aldehyde that does not have one or more carboxylic acid groups attached directly to its aromatic ring is not furfural.

2. The method of claim 1, wherein the aromatic aldehyde that does not have one or more carboxylic acid groups attached directly to its aromatic ring is a furfural derivative.

3. The method of claim 2, wherein the anode electrolyte solution has a pH of 3 or lower.

4. The method of claim 2, wherein the aromatic aldehyde that does not have one or more carboxylic acid groups attached directly to its aromatic ring is 5-hydroxymethylfurfural and the carboxylic acid is 2,5-furandicarboxylic acid.

5. The method of claim 4, wherein the anode electrolyte solution has a pH of 2 or lower.

6. The method of claim 4, wherein the anode comprises manganese oxide.

7. The method of claim 4, wherein the 2,5-furandicarboxylic acid is produced with a yield of at least 50%.

8. The method of claim 7, wherein the anode electrolyte solution has a pH of 2 or lower.

9. The method of claim 2, wherein the carboxylic acid comprises maleic acid.

10. The method of claim 9, wherein the aromatic aldehyde that does not have one or more carboxylic acid groups attached directly to its aromatic ring is 5-hydroxymethylfurfural.

11. The method of claim 10, wherein the anode comprises $PbO_2$.

12. The method of claim 9, wherein the anode comprises manganese oxide, $CeO_2$, $PbO_2$, carbon, platinum, or a combination of two or more thereof.

13. The method of claim 1, wherein the anode comprises $PbO_2$, $CeO_2$, $WO_3$, $TiO_2$, $Ta_2O_5$, $Nb_2O_5$, $IrO_2$, $RuO_2$, Au, Pd, Pt, or carbon.

14. The method of claim 1, wherein the anode comprises manganese oxide, $CeO_2$, $PbO_2$, carbon, platinum, or a combination of two or more thereof.

15. The method of claim 1, wherein the anode comprises manganese oxide, $CeO_2$, carbon, platinum, or a combination of two or more thereof.

16. The method of claim 1, wherein the anode comprises $CeO_2$, carbon, or platinum.

17. The method of claim 1, further comprising adding an acid and a buffer to the electrolyte solution in order to maintain the pH of the anode electrolyte solution at a pH of 4 or lower.

18. The method of claim 1, wherein the electrochemical oxidation is carried out at a first temperature at which at least some of the carboxylic acid is soluble in the anode electrolyte solution, the method further comprising:

lowering the temperature of the anode electrolyte solution to a second temperature at which the carboxylic acid precipitates out of the anode electrolyte solution; and separating the carboxylic acid from the anode electrolyte solution.

19. The method of claim 18, wherein the anode electrolyte solution has a pH of 3 or lower.

20. The method of claim 19, wherein the aromatic aldehyde that does not have one or more carboxylic acid groups attached directly to its aromatic ring is 5-hydroxymethylfurfural and the carboxylic acid is 2,5-furandicarboxylic acid.

* * * * *